US010955087B2

(12) United States Patent
Carvalho Ferreira

(10) Patent No.: US 10,955,087 B2
(45) Date of Patent: Mar. 23, 2021

(54) PRESSURE VESSEL

(71) Applicant: ATIVATEC TECNOLOGIA E DESENVOLVIMENTO LTDA - EPP, Rio de Janeiro (BR)

(72) Inventor: Rodrigo Carvalho Ferreira, Rio de Janeiro (BR)

(73) Assignee: ATIVATEC TECNOLOGIA E DESENVOLVIMENTO LTDA—EPP, Rio de Janeiro (BR)

( * ) Notice: Subject to any disclaimer, the term of this patent is extended or adjusted under 35 U.S.C. 154(b) by 53 days.

(21) Appl. No.: 16/326,862

(22) PCT Filed: Aug. 21, 2017

(86) PCT No.: PCT/BR2017/050238
§ 371 (c)(1),
(2) Date: Feb. 20, 2019

(87) PCT Pub. No.: WO2018/039763
PCT Pub. Date: Mar. 8, 2018

(65) Prior Publication Data

US 2019/0211969 A1 Jul. 11, 2019

(30) Foreign Application Priority Data

Sep. 5, 2016 (BR) ..... 20160205166

(51) Int. Cl.
*F17C 1/00* (2006.01)
*B65D 90/00* (2006.01)
*F17C 13/00* (2006.01)

(52) U.S. Cl.
CPC ..... *F17C 1/00* (2013.01); *B65D 90/00* (2013.01); *F17C 13/00* (2013.01); *F17C 2201/0104* (2013.01); *F17C 2201/0119* (2013.01); *F17C 2201/054* (2013.01); *F17C 2203/0617* (2013.01); *F17C 2203/0636* (2013.01); *F17C 2203/0658* (2013.01); *F17C 2203/0695* (2013.01); *F17C 2205/0311* (2013.01); *F17C 2209/228* (2013.01); *F17C 2209/232* (2013.01); *F17C 2223/0123* (2013.01); *F17C 2223/035* (2013.01)

(58) Field of Classification Search
CPC ..... F17C 2201/0104; F17C 2201/0119; F17C 2209/228; F17C 2209/232; F17C 2205/0311
USPC ..... 220/4.17, 4.16, 4.12
See application file for complete search history.

(56) References Cited

U.S. PATENT DOCUMENTS 5,607,384 A * 3/1997 Caparros ..... F17C 1/00 588/259
6,354,457 B1 * 3/2002 Aaron ..... F17C 1/00 220/581

* cited by examiner

*Primary Examiner* — Stephen J Castellano
(74) *Attorney, Agent, or Firm* — Nevrivy Patent Law Group P.L.L.C.

(57) ABSTRACT

It concerns the invention of a pressure vessel (VP) which can be assembled from individual parts, and basically comprises: a plurality of wall modules (MP), at least one connection module (MC) for pipes or sensors, and closing modules (MF) that can be chosen from: have equal configuration and have different configurations. All of the modules have bores (105) distributed radially on their flat surfaces (101) and these bores (105) are distributed between a hollow drill (1051) with a seat (1151) and a torque screw bored (1052) (106) inserted therein attach a module to another adjacent module, with a sealing ring (104) therebetween.

3 Claims, 10 Drawing Sheets

PRESSURE VESSEL

This application is the national stage (Rule 371) of international application No. PCT/BR2017/050238 filed Aug. 21, 2017.

FIELD OF THE INVENTION

The present invention finds its field of application among containers designed to hold gases or liquids at a pressure substantially different from ambient pressure, known as a pressure vessel. More particularly, pressure vessels of the high pressure segmented type, which may be internal or external. More specifically a segmented pressure vessel, which can be assembled from individual parts, the characteristics of which allow, once joined, to contemplate various design configurations.

BACKGROUND OF THE INVENTION

The industry transforms raw material into compounds that will ultimately be consumed. To do so, this raw material undergoes a series of transformations, the result of one or more processings and are finally stocked until its use.

Various processes as well as end products are carried out under pressure, which may be higher or lower than atmospheric pressure.

In order for these products to be stocked or processed, closed containers with sufficient strength are used to withstand the pressures submitted to their body. In the same way, this container often also has to withstand different temperatures than the environment.

Such containers are commonly referred to as pressure vessels and generally designate all equipment in the form of watertight containers of any type, size, shape or purpose which are capable of containing pressurized fluids. Depending on the design, such vessels may operate from vacuum to pressures above 3000 kg/cm2, as well as temperatures ranging from absolute zero to greater than 1000° C.

One of the procedures for constructing a pressure vessel is calendering. In this procedure an equipment known as calender is used, which is constituted by a set of rollers or cylinders, which work with a rotating movement and a pressure that can be regulated. Bending is accomplished by passing the material, usually a sheet between the rollers or rollers which rotate and press until the bending is within the desired design specifications. The curving of thin plates can be done in the cold, however, for plates considered of great thickness, the hot bending facilitates the obtaining of a final result, in this case of application, generally a cylinder. Forging, machining and welding are also employed. In any case, the conformation processing has as a characteristic the preservation of the integrity of the materials.

A large part of the pressure vessels is constructed in this way: a plate of a certain thickness, curved to form a cylinder, which is closed by the union of the ends of the curved plate, usually by resistant welds. Depending on the pressure requirement, the cylinder wall needs to be reinforced by means of external elements. One such means may be a system of cables wound around a central steel cylinder. Such cables may be, for example, carbon fiber which has the characteristic of being light but very complex to manufacture. Others may be wound on a composite element, metals, ceramics or polymers, depending on the application and taking into account that this coating will also undergo a portion of the pressure load contained within the vessel.

Increasingly with the expansion of the industry, pressure vessels need to be larger as well. The calendering industry for this type of requirement is rare and the transportation and logistics for this type of piece of equipment is very complicated, expensive and takes a long time to be made and transported to its destination.

The pressure vessels also had to provide means for ensuring integrity for both the core and the coatings. Long screws were used to maintain the union, positioning and integrity of the seals between elements. Gradually the sizing and the demand of higher and higher pressures became a limiting factor. Examples of prior art documents illustrating the types of pressure vessels discussed so far are:

GB 1157394A—In this document the design principle is based on the elimination of the hoop stress in the thick wall thickness, and replacing it with a design that gives a uniform tension tension along its thickness. This construction consists of dividing the coating cylinder circumferentially into a series of short bonds. It is much more like a brick wall, with the overlapped bricks held together by connecting pins. The lengths of the connecting pins of the cylinder pass through the holes of the connections. The effect is a multi-sided polygon with a uniform voltage distribution across the thickness of the polygon bonding members. An inner liner or thin sealing membrane may be employed to prevent leakage of the fluid. The width of the segments and the diameter of the pivot pins are based (projected) on the shear, tensile and load resistance properties of the materials used, as well as the design of the bolted or riveted joints. As for closing the heads of this vessel it is necessary that the pivot pins are also used to fix the closing flange of the cylinder and, under this condition, they also receive the longitudinal tension;

U.S. Pat. No. 4,111,327 A—This patent is similar to patent GB1157394A, and still uses the filament winding system, also known to those skilled in the art, by the English term "Filament Winding", to pre-strain the vessel wall and thereby generate a structure already with a compression tension, that will be used to counterbalance the internal pressure of the pressure vessel. Filament winding is a manufacturing technique used primarily for the manufacture of uncovered cylinders or closed end structures (pressure vessels or tanks). The process involves winding filaments under tension along a rotating mandrel.

The technique still resists a way of constructing pressure vessels which have flexibility of adaptation according to the design requirements, absence of welds, dispense the calendering process, support high pressures, are simpler to manufacture, with cost and without the need for large logistics to transport to the place where it will be installed.

SUMMARY OF THE INVENTION

Object of the invention is a pressure vessel for maintaining gases or liquids at a pressure substantially different from ambient pressure. More particularly, pressure vessels of the segmented type of large diameter and high pressure, which may be internal or external.

The object is achieved by designing a pressure vessel, which can be assembled from individual parts, the characteristics of which allow, once joined, to contemplate various design configurations.

The pressure vessel of the invention basically comprises: a plurality of wall modules, at least one connecting module for pipes or sensors, and closure modules which may be chosen from: having the same configuration and having different configurations.

All of the modules have holes distributed radially on the flat surfaces of the cylinder forming them, these holes are distributed between holes with a seat and alternately positioned locking holes, where the screws inserted in them insert a module to another adjacent module, with a sealing element therebetween.

DETAILED DESCRIPTION OF THE INVENTION

The present invention relates to a pressure vessel for maintaining gases or liquids at a pressure substantially different from the ambient pressure. More particularly, high-pressure, segmented type pressure vessels, which may be internal or external, and which can be assembled from individual parts, the characteristics of which permit, once joined, to contemplate various design configurations.

As is known in the art, the wall of the vessel as it will be called the wall of the formed cylinder, increases in size according to the diameter of the vessel itself and the pressure to which it will be subjected. This is because the normal tension in the wall of the vessel is inversely proportional to the thickness of the walls. This is the greatest limitation for the construction of conventional pressure vessels, since the critical tensions reside on the wall of the vessel: radial, circumferential, axial, and the forms of construction of these walls, the thicker and larger the internal diameter, are barriers to the machines that manufacture them.

The effect caused by the high circumferential tension on coarse wall cylinders is known as the "Lame Effect" (Gabriel Lamé). The theoretical treatment of thin-walled cylinders assumes that the circumferential tension is constant across the whole wall thickness of the cylinder. It is also considered that there is no radial stress gradient caused by pressure along the wall.

However, none of these assumptions can be used in the case of thick-walled cylinders. The variation of the circumferential stress and the radial stress are calculated by the Lamé equations.

Figure 1:
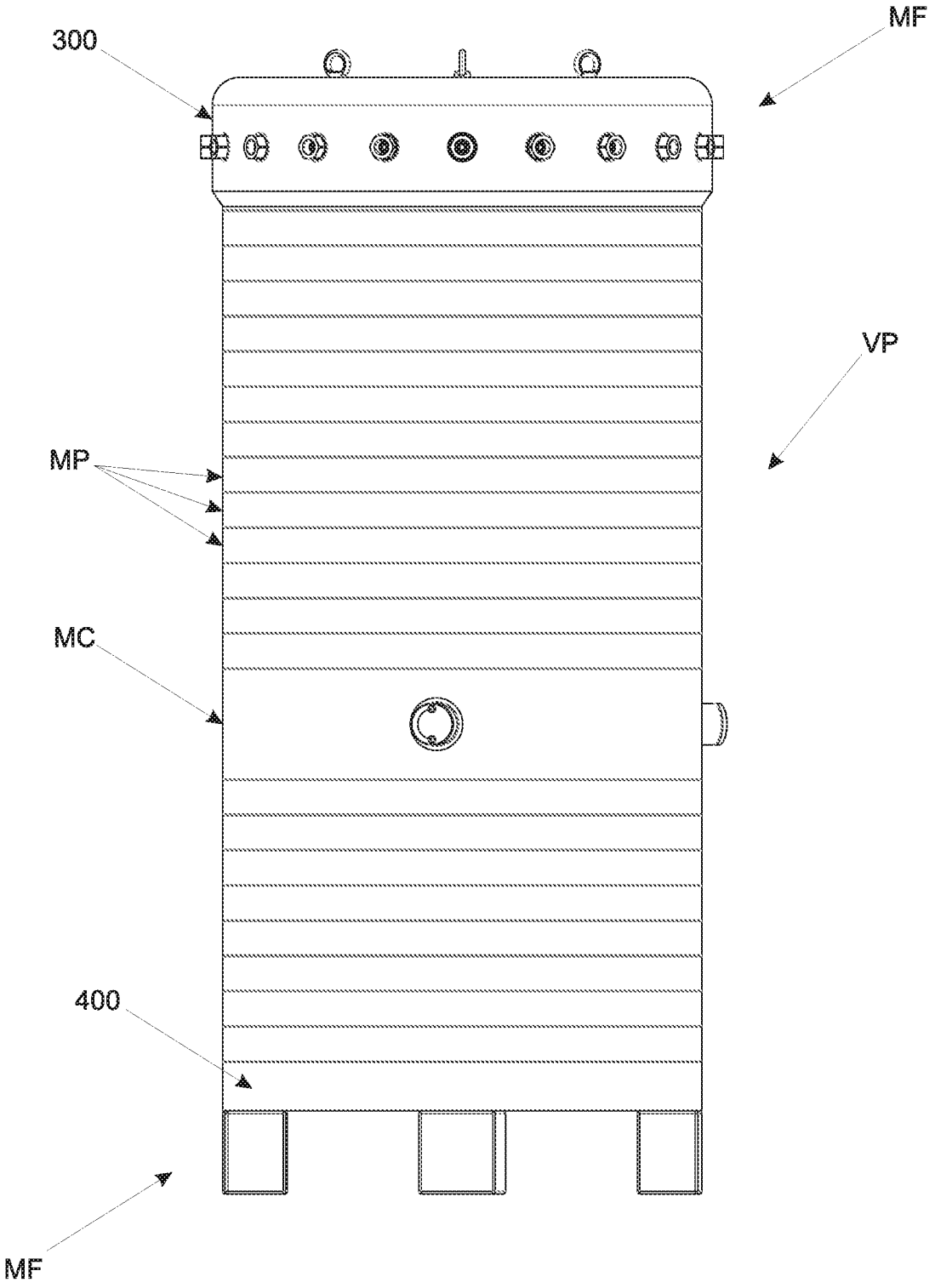
FIG. 1 shows a side view of a possible embodiment of a pressure vessel according to the present invention.
Figure 2:
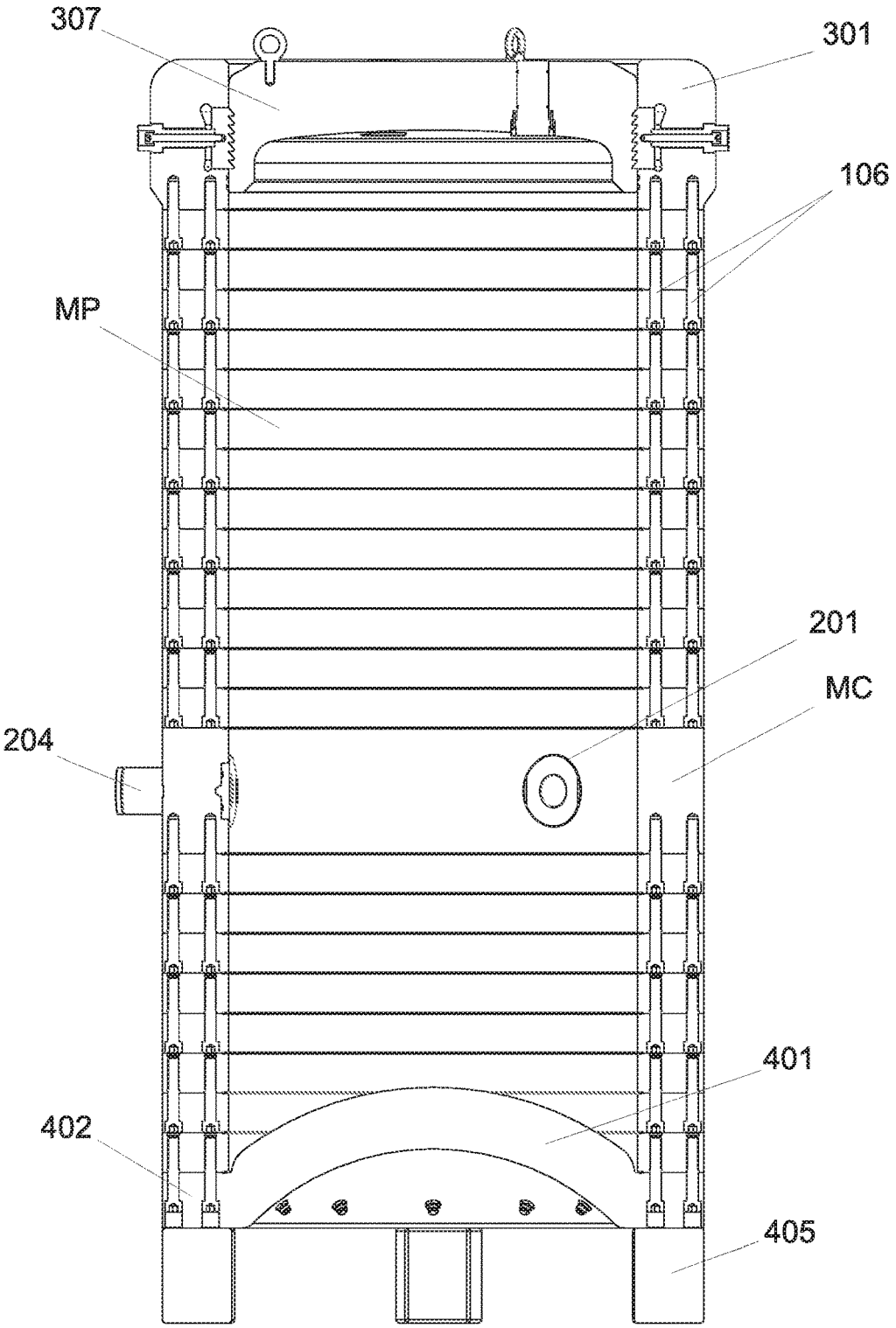
FIG. 2 shows a longitudinal cross-sectional side view of the possible embodiment of FIG. 1.
Figure 3:
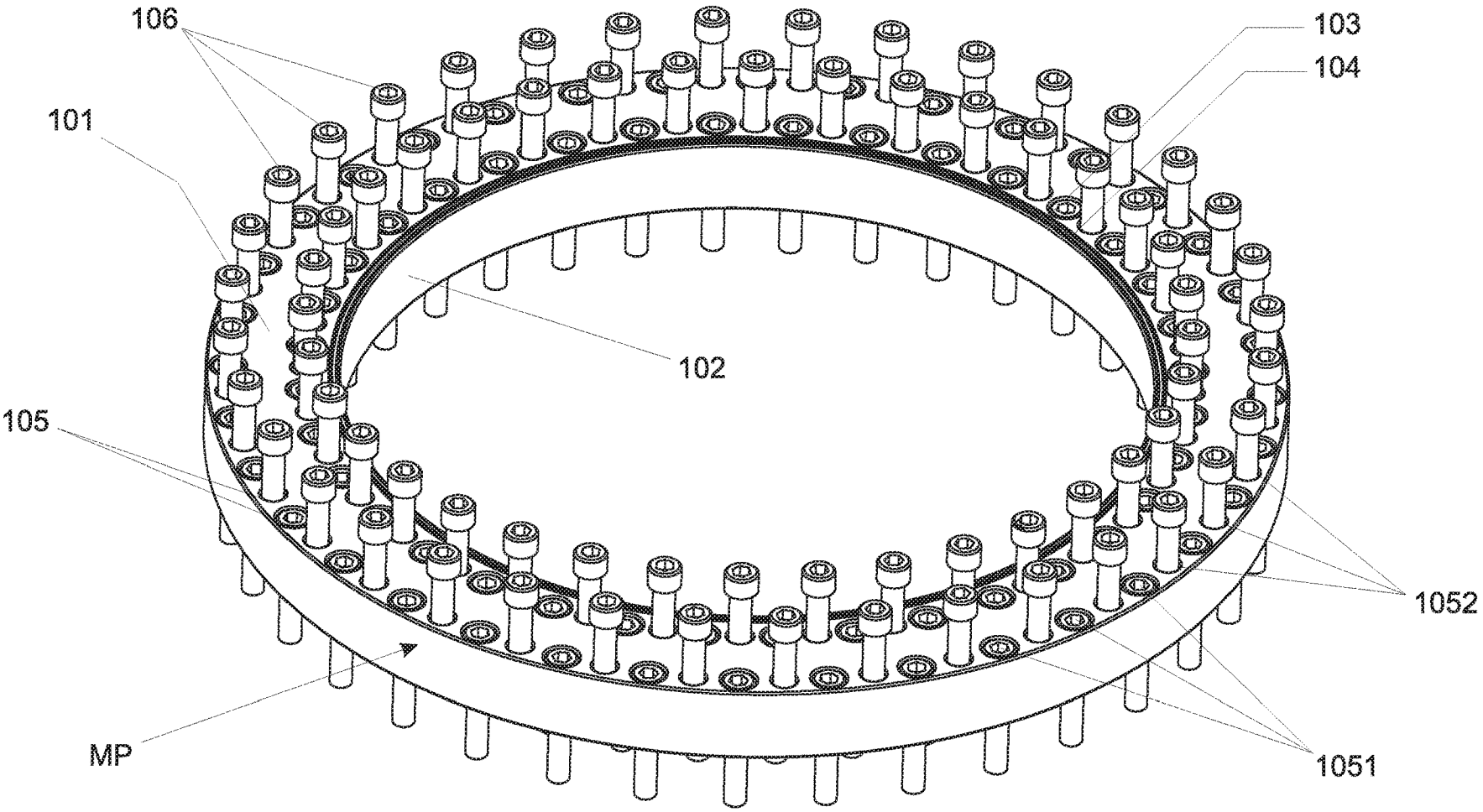
FIG. 3 shows an embodiment of a wall module with hole distribution in two diameters.
Figure 4:
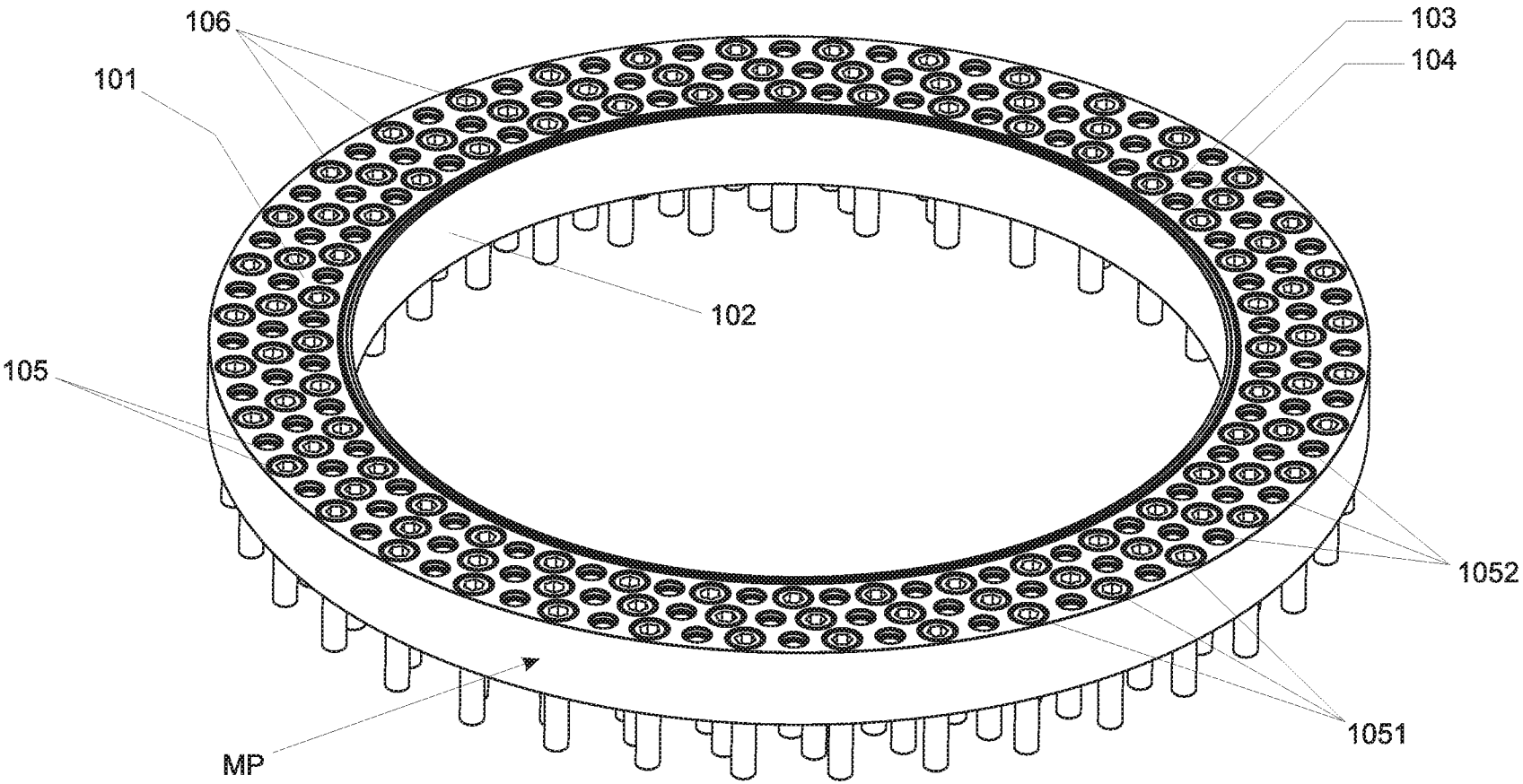
FIG. 4 shows an embodiment of a wall module with hole distribution in three diameters.
Figure 5:
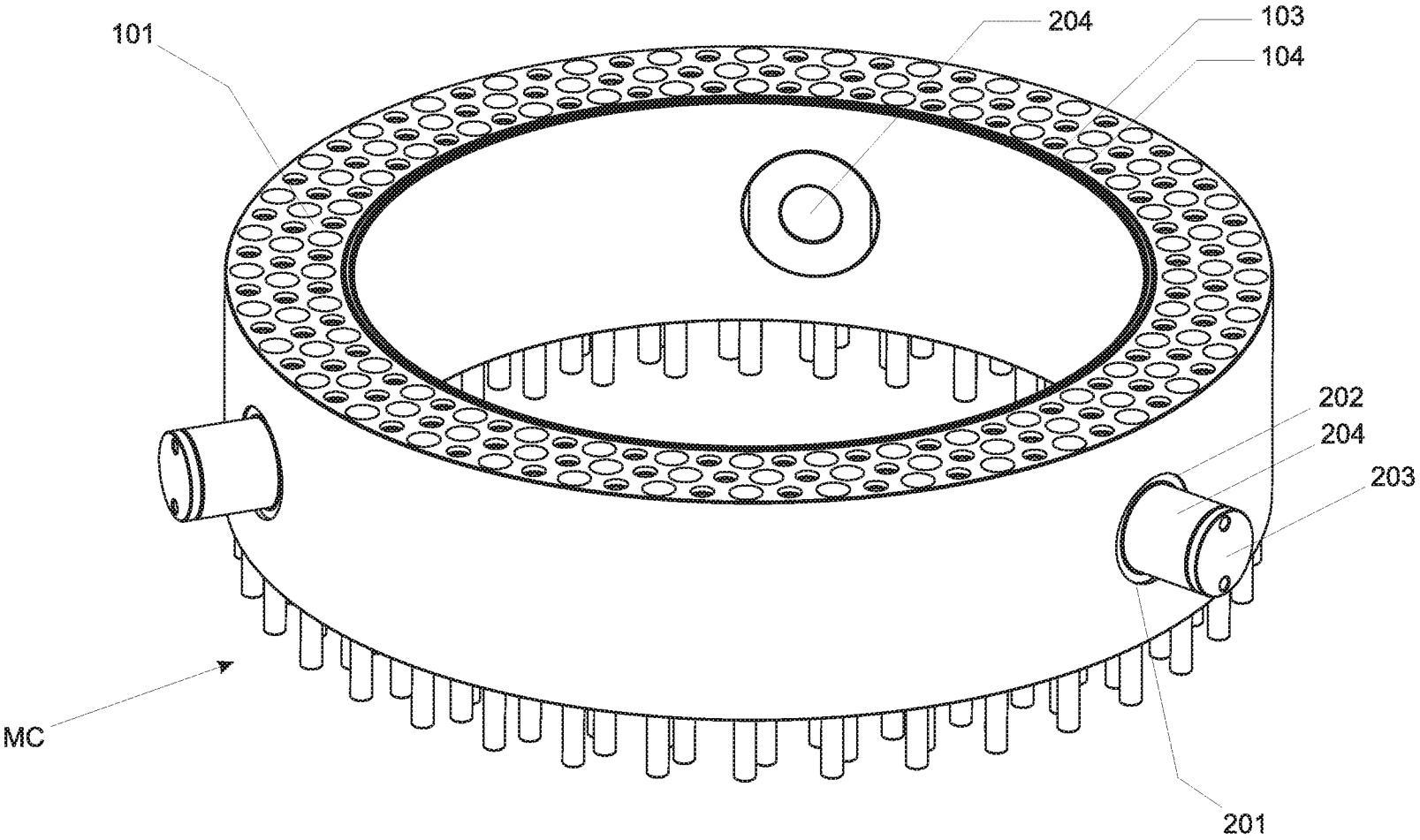
FIG. 5 shows an embodiment of a connection module for the pressure vessel according to the present invention.
Figure 6:
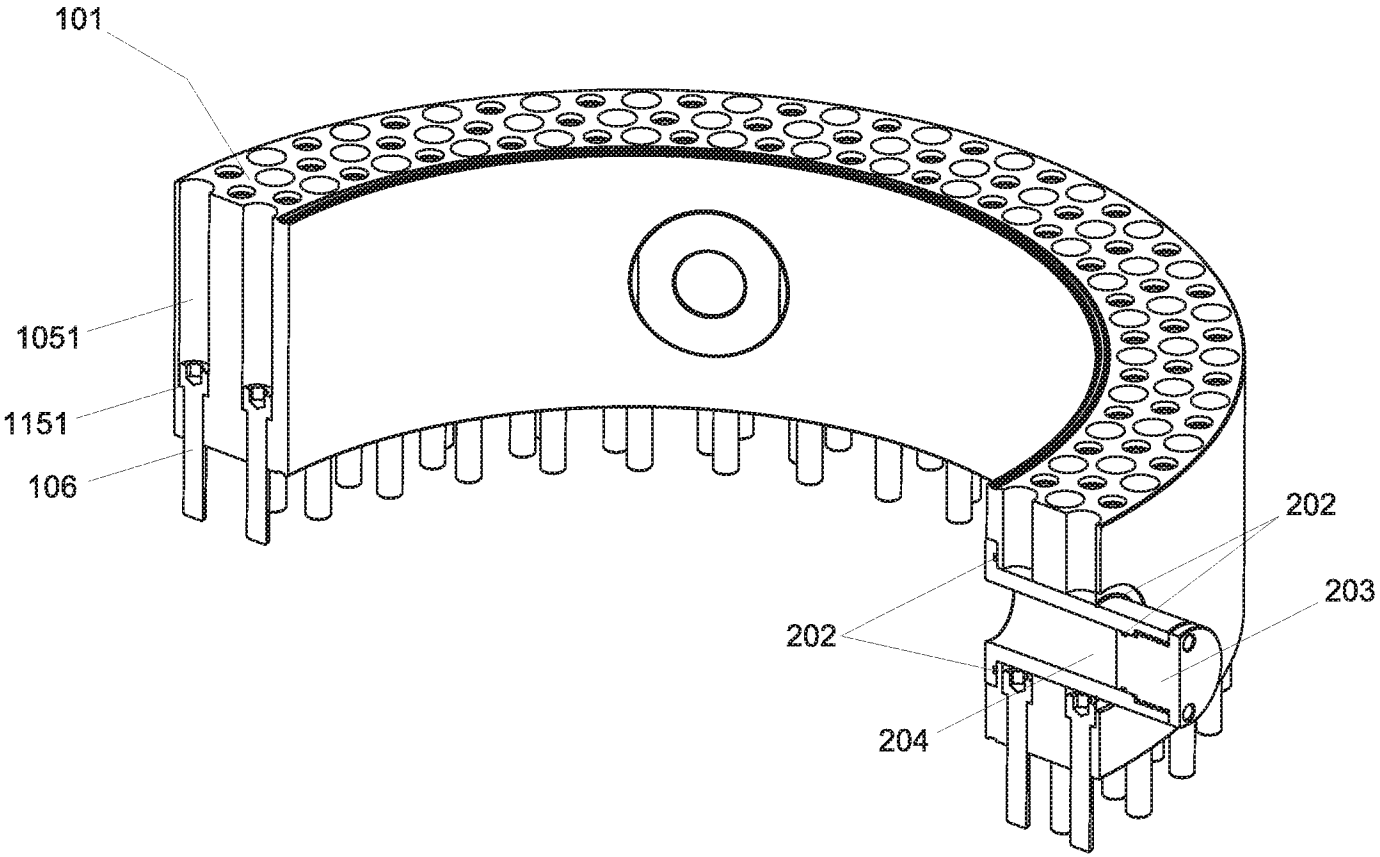
FIG. 6 shows a diametrical cross-sectional view of the connection module of FIG. 5.
Figure 7:
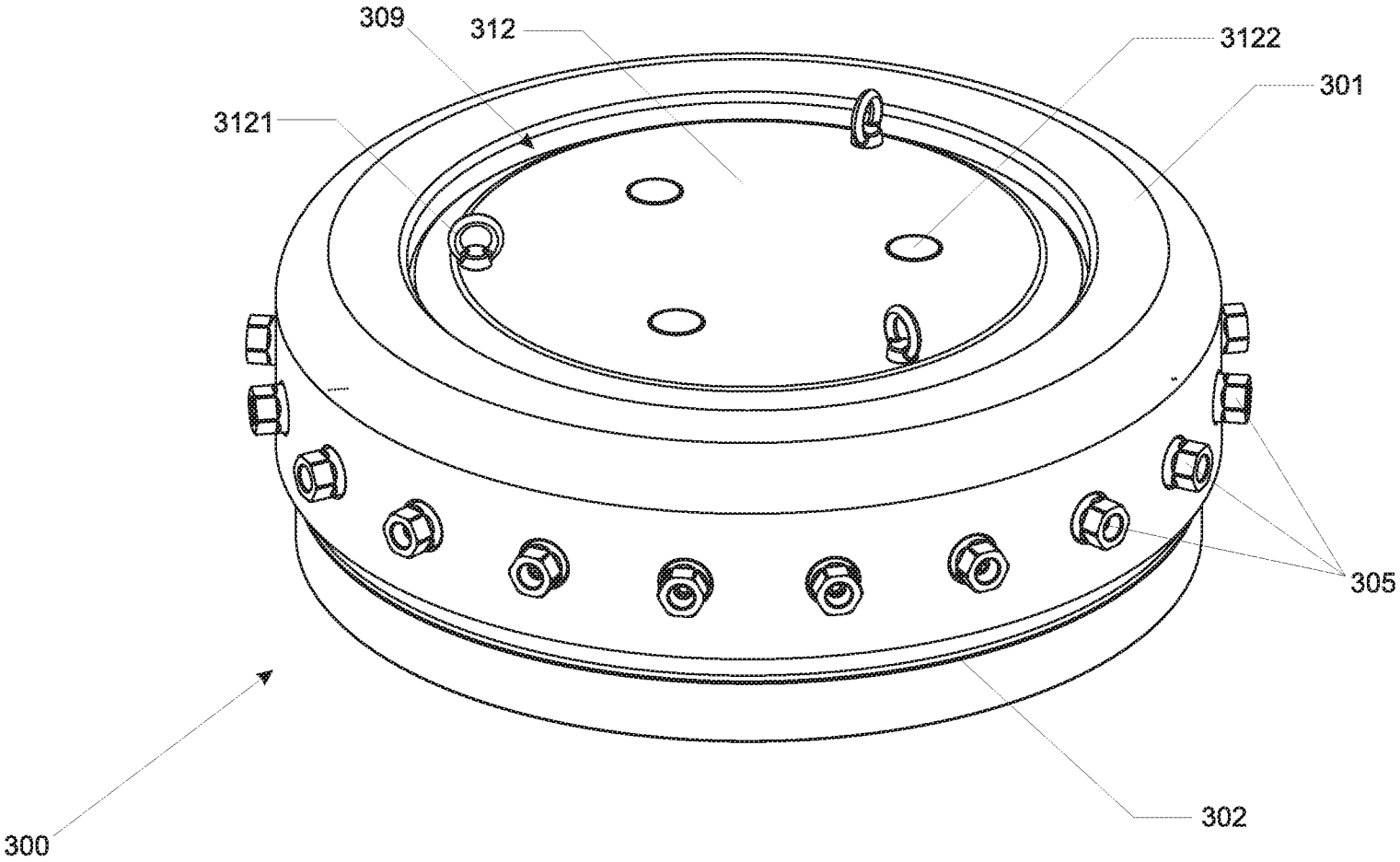
FIG. 7 shows a perspective view of a possible embodiment for the top closure module for the pressure vessel according to the present invention.
Figure 8:
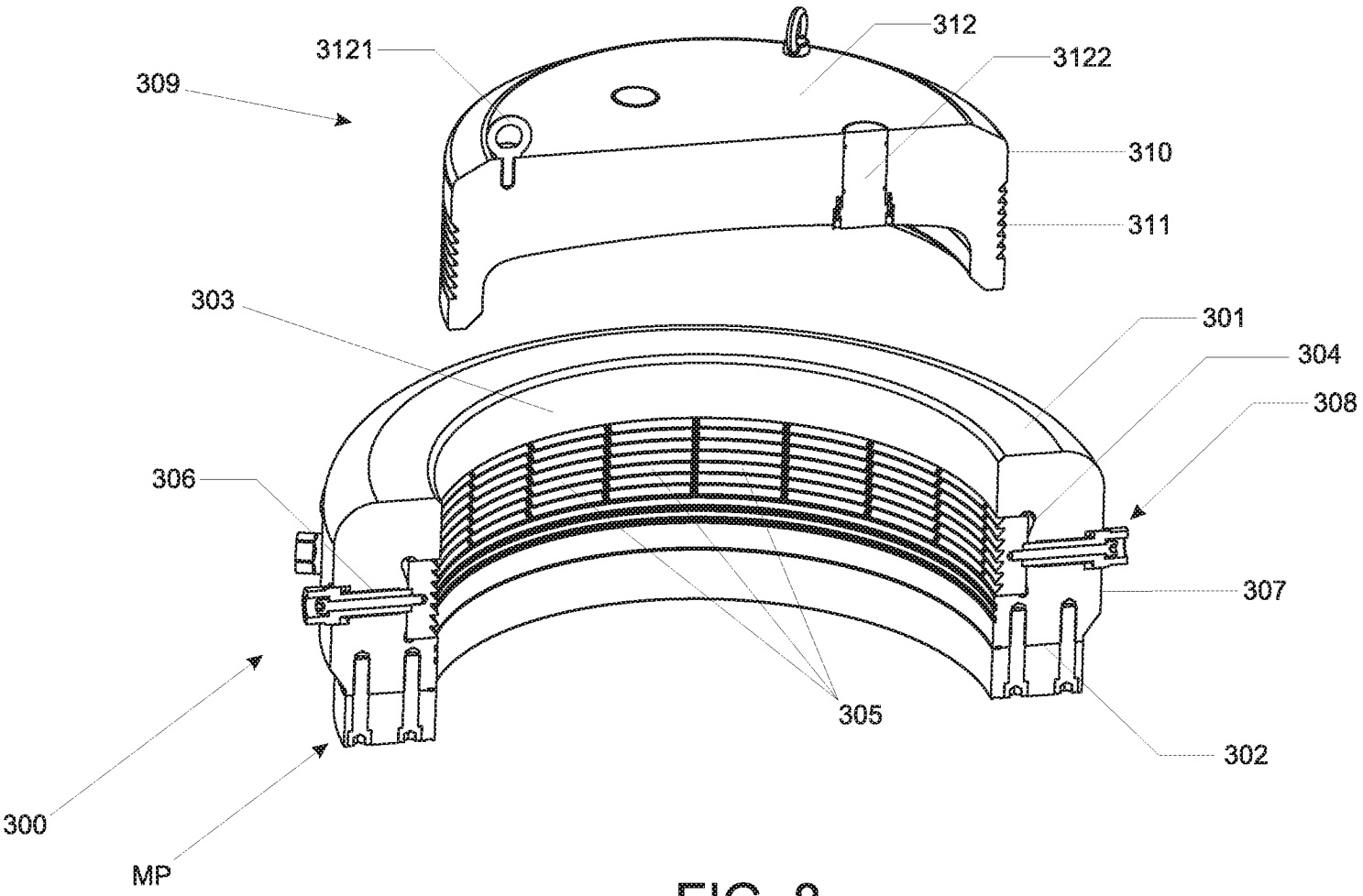
FIG. 8 shows a diametrical cross-sectional view of the top closure module of FIG. 7 with the top flange separate from the top ring and the latter attached to a wall module.
Figure 9:
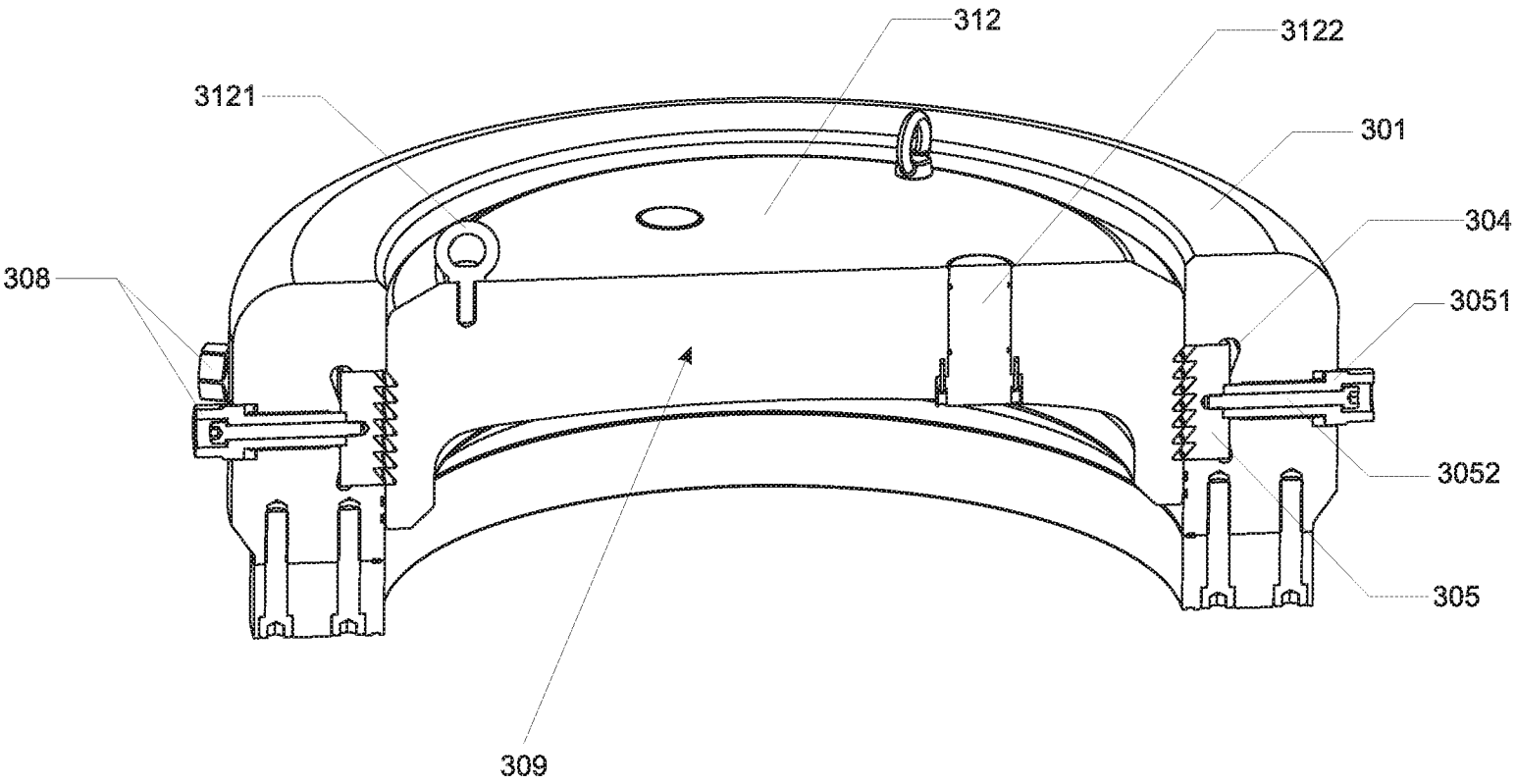
FIG. 9 shows a diametrical cross-sectional view of the top closure module of FIG. 7 with the top flange locked to the top ring.
Figure 10:
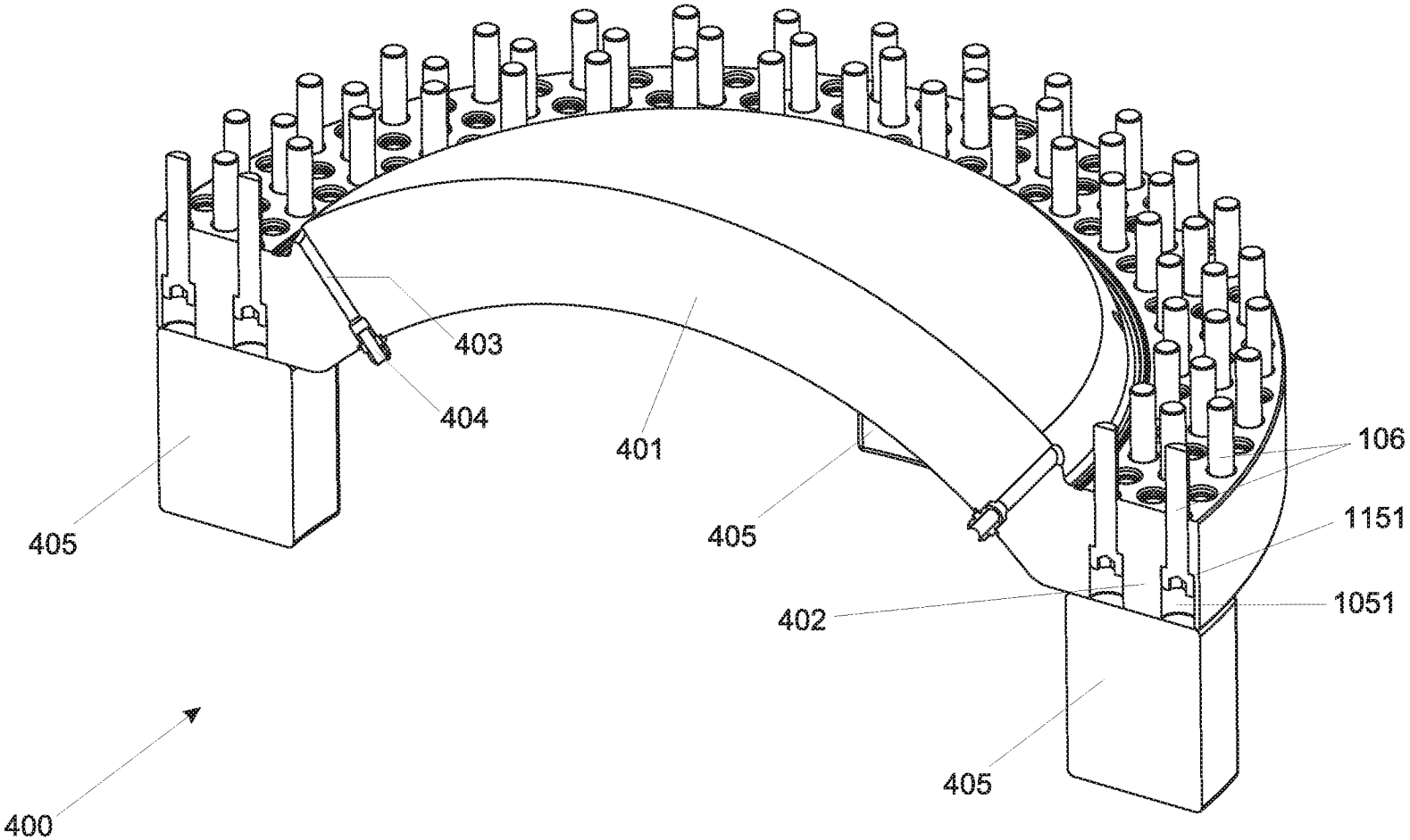
FIG. 10 shows a perspective view of a possible embodiment for the bottom closure module for the pressure vessel according to the present invention.

The pressure vessel (VP) (FIGS. 1 and 2) object of the invention is constituted by cylinders, which will be called hereinafter and generally by modules, which are obtained by means of cutting of plates with internal diameter, diameter external and heights that are dependent on the individual characteristics of each project and comprise the following types:

- a plurality of wall modules (MP), (FIGS. 3 and 4) where each has:
  - on both flat surfaces 101 near the inner diameter limit 102, a recess 103 is adapted to house a sealing ring 104 so as to promote an energized seal between two modules which are attached;
  - a plurality of bores (105) distributed over one of the flat surfaces (101) of each wall module (MP) in a circular manner in modalities which may be chosen from: at least two diameters to three diameters for pressure vessels (VP) which work at lower pressure and a plurality of diameters for larger wall thicknesses in pressure vessels (VP) working at higher pressures, wherein;
  - for each diameter, these bores (15) are arranged in sequence as follows: a hollow drill (1051) with a seat (1151) (FIG. 10) followed by a screw-threaded drill (1052) where;
  - by the interior of a hollow drill (1051), a torque screw (106) is inserted and threaded into the torque screw boring (1052) of the adjacent module until its head (1061) touches the seat (1151) and joins the two modules;
- at least one connecting module (MC) (FIGS. 5 and 6), with the same characteristics of bores and sealing ring (104) of the wall module (MP), with a height greater than the latter, presents along of its outer wall apertures (201), through which are secured with sealing device (202) and occasional occlusion device (203), hollow penetrators (204) for connection of pipes as well as for connection of sensors;
- closure modules (MF) that may be chosen between being of equal or different configuration are subdivided into: a top closure module 300 and a bottom module 400 where:
  - the top closure module (300) (FIGS. 7, 8 and 9) comprises:
    - a machined top ring (301) having the same characteristics as the abovementioned modules in which, on its lower circular surface (302), there are only screw-threaded bores (1052) with positioning compatible with the hollow drilled holes (1051) (301) of the wall module (MP) to which it is to be connected in the inner wall (303) of the top ring (301) is machined a recess (304) within which a plurality of jaw segments (305) a plurality of threaded holes 306 traverse the outer wall 307 of the top ring 301 in the region of the recess 304 for insertion of dual-function screws 308 serving to fix and drive each segment of the mandible (305);
    - is a top flange 309 which has on its outer wall 310 engagement grooves 311 in which the jaws 305 of the top ring 301 on its upper surface 312 are locked, at least three penetrators (3122) are adapted for connection of pipes as well as for connection of sensors identical to those of the connection module (MC);

the bottom closure module 400 (FIG. 10) comprises a disk 401 which may have various configurations, such as a concave configuration, in which structurally follows an outer flat ring 402 where there are hollow bores 1051 with (1151) of the wall module (MP) to which it is to be connected follows a surface that can be chosen between having a concave configuration for the interior of the vessel and convex, depending on the design, and near the periphery of these configurations are inlet or outlet holes (403) with occluding plugs (404) for fitting fittings and, in addition, feet (405) can be attached in case the equipment operates in foot.

The torque screws (106) are chosen to have twice the maximum torque capacity required in any type of pressure vessel (VP) design.

The dual function screws 305 (FIG. 9) comprise: an outer screw 3051, with its central portion hollow, which serves to drive the jaw 305 against the engagement grooves 309 of the flange (305) and a return screw (3052) inserted through the interior of the outer screw (3051) and serves to secure the mandible (305) within the recess (304) in the inner wall (303) of the top ring (301).

The torque screws (106) are short, intended to join modules two to two, facilitate assembly and increase the bond strength between the modules. Due to the use of a larger number of bolts, the diameter of these bolts decreases and thus the torque in each bolt is decreased and increases the reliability of the bolt because there is a large number of bolts that add up and give the necessary force for the union between the bolts modules.

When the torque is applied to the torque screws (106), there is practically no possibility of the modules moving away since the compressive force caused by the union between the latter is greater than the radial force produced by the effect of the modules of closure (MF).

The very thickness of the modules distributes the circumferential tension and the radial tension.

The design of the pressure vessel (PV) object of the present invention has as advantages the manufacture of its components by conventional means and within reach of the domestic industry, much lower cost for the production and much easier transport logistics for the place of installation.

Although the present invention has been described in its preferred embodiment, the main concepts guiding the present invention which are a pressure vessel for maintaining gases or liquids at a pressure substantially different from the ambient pressure of the large segmented type diameter and high pressure, which can be internal or external and can be assembled from individual parts, whose characteristics allow, once united, to contemplate various design configurations, preserved for its innovative character, where those usually versed in the art they may envisage and practice variations, modifications, alterations, adaptations and equivalent equivalents compatible with the work medium in question, without, however, departing from the scope of the spirit and scope of the invention, which are represented by the following claims.

The invention claimed is:

1. A pressure vessel characterized in that it consists of modules, which are obtained by means of cutting of plates with internal diameter, external diameter and heights depending on the individual characteristics of a project, the modules comprising the following types:

a plurality of wall modules, where each has: on both flat surfaces near the inner diameter limit, a recess that is adapted to house a sealing ring so as to promote an energized seal between two modules which are attached to each other; a plurality of bores distributed over one of the flat surfaces of each wall module in a circular manner in modalities which are selected from the group consisting of: at least two diameters to three diameters for pressure vessels which work at lower pressure and a plurality of diameters for larger wall thicknesses in pressure vessels working at higher pressures, wherein; for each diameter, these bores are arranged in sequence as follows: a hollow drill with a seat followed by a screw-threaded drill where; by the interior of a hollow drill, a torque screw is inserted and threaded into the torque screw boring of the adjacent module until its head touches the seat and joins the two modules;

at least one connecting module, with the same characteristics of bores and sealing ring of the wall modules, with a height greater than the latter, which presents along its outer wall apertures, through which are secured with a sealing device and an occasional occlusion device, hollow penetrators for connection of pipes as well as for connection of sensors; and closure modules chosen to be either of equal or of different configuration and subdivided into: a top closure module and a bottom closure module, where:

the top closure module comprises:

a machined top ring having the same characteristics as the above mentioned modules in which, on its lower circular surface, there are only screw-threaded bores with positioning compatible with the hollow drilled holes of the wall module to which it is to be connected; in an inner wall of the top ring is machined a mandible recess within which a mandible comprising a plurality of jaw segments resides, and a plurality of threaded holes traverse the outer wall of the top ring in the region of the mandible recess for insertion of dual-function screws serving to fix and drive each segment of the mandible; a top flange which has on its outer wall engagement grooves in which the jaws of the top ring are locked; and at least three penetrators adapted for connection of pipes as well as for connection of sensors identical to those of the connection module; and the bottom closure module comprises a disk having a concave configuration or a convex configuration, in which a pattern of hollow bores and corresponding seats structurally follows an outer flat ring where the hollow bores and seats are compatible with the wall module to which the bottom closure module is to be connected, where the bottom closure module has a surface having either a concave configuration or a convex configuration facing the interior of the vessel, where near the periphery of these configurations are inlet or outlet holes with occluding plugs for fitting fittings and, optionally, where feet are attached in the case of a stand-up apparatus.

2. The pressure vessel according to claim 1, characterized in that the torque screws are chosen to have twice the maximum torque capacity required in any type of pressure vessel design.

3. The pressure vessel according to claim 1, characterized in that at least one closure module comprises: an external screw, with its central part cast, which serves to drive the jaws against the engagement grooves and a return screw inserted through the interior of the external screw, which return screw serves to secure the mandible within the mandible recess in the inner wall of the top ring.

* * * * *